US009377261B2

(12) United States Patent
Aberg et al.

(10) Patent No.: US 9,377,261 B2
(45) Date of Patent: Jun. 28, 2016

(54) REPEATABLE PLASMA GENERATOR AND A METHOD THEREFOR

(75) Inventors: Denny Aberg, Karlskoga (SE); Fredrik Olsson, Orebro (SE)

(73) Assignee: BAE Systems Bofors AB, Karlskoga (SE)

( * ) Notice: Subject to any disclaimer, the term of this patent is extended or adjusted under 35 U.S.C. 154(b) by 0 days.

(21) Appl. No.: 13/993,585

(22) PCT Filed: Nov. 30, 2011

(86) PCT No.: PCT/SE2011/000217

§ 371 (c)(1), (2), (4) Date: Nov. 26, 2013

(87) PCT Pub. No.: WO2012/082039

PCT Pub. Date: Jun. 21, 2012

(65) Prior Publication Data

US 2014/0083317 A1 Mar. 27, 2014

(30) Foreign Application Priority Data

Dec. 15, 2010 (SE) ..... 1001194

(51) Int. Cl.
*F41A 19/63* (2006.01)
*F41A 19/60* (2006.01)
(Continued)

(52) U.S. Cl.
CPC ..... *F41A 19/63* (2013.01); *F41A 19/60* (2013.01); *F42B 3/14* (2013.01); *F42C 19/0811* (2013.01); *F42C 19/12* (2013.01); *H05H 1/52* (2013.01); *F42B 5/08* (2013.01)

(58) Field of Classification Search
CPC ..... F42B 5/08; F42B 3/14; F42C 19/12; F42C 19/0811; F41A 19/58; F41A 19/60; F41A 19/63; H05H 1/24; H05H 1/52
USPC ..... 102/202, 202.5, 202.8, 200
See application file for complete search history.

(56) References Cited

U.S. PATENT DOCUMENTS 4,640,180 A 2/1987 Rose
4,711,154 A * 12/1987 Chryssomallis ..... F41B 6/00 102/440
4,957,035 A * 9/1990 Eskam ..... F41B 6/00 89/8

(Continued)

FOREIGN PATENT DOCUMENTS

GB 2 276 801 A 10/1994
GB 2312733 A 11/1997

(Continued)

OTHER PUBLICATIONS

Extended European Search Report issued Aug. 3, 2015 in EP Appln No. 11848738.

*Primary Examiner* — James S Bergin
(74) *Attorney, Agent, or Firm* — Polsinelli PC

(57) ABSTRACT

The invention concerns a method for repeatable ignition of propellant charges in a weapon system, e.g. for firing shells from a barrel weapon, through electrical discharge in a combustion chamber duct (3) containing a combustion chamber substance (30), wherein the filling gas in the combustion chamber duct (3) is ionized by the high-voltage potential applied to the ionizing electrode (7), which is connected to a first high-voltage generator (2), thus increasing the electrical conduction capacity in the combustion chamber duct (3) such that an electrical sparkover through electrical discharge via a second high-voltage generator (5) between a rear electrode (22) and a front electrode (21) is generated and produces an effect, with subsequent ionization of the surface of the combustion chamber substance (30), which causes hot gas in a plasma-like state to be expelled from the combustion chamber duct (3). The invention also concerns a plasma generator therefor, and an ammunition unit containing said plasma generator.

19 Claims, 3 Drawing Sheets

(51) Int. Cl.

| | |
|---|---|
| ***F42B 3/14*** | (2006.01) |
| ***F42B 5/08*** | (2006.01) |
| ***F42C 19/12*** | (2006.01) |
| ***H05H 1/52*** | (2006.01) |
| ***F42C 19/08*** | (2006.01) |

(56) References Cited

U.S. PATENT DOCUMENTS 4,974,487 A * 12/1990 Goldstein ..... F41B 6/00 124/3
5,072,647 A * 12/1991 Goldstein ..... F42C 19/0811 102/202.8
6,186,040 B1 * 2/2001 Weise ..... F41B 6/00 102/472
2002/0134767 A1 9/2002 Brunet et al.
2006/0096489 A1 * 5/2006 Stark ..... F42B 5/297 102/469

FOREIGN PATENT DOCUMENTS

GB 2 470 174 A 11/2010
WO WO-2009123526 A1 10/2009

* cited by examiner

REPEATABLE PLASMA GENERATOR AND A METHOD THEREFOR

CROSS REFERENCE TO RELATED APPLICATIONS

This application is a National Phase filing under 35 U.S.C. §371 of PCT/SE2011/000217 filed on Nov. 30, 2011; and this application claims priority to Application No. 1001194-8 filed in Sweden on Dec. 15, 2010, under 35 U.S.C. §119; the entire contents of all are hereby incorporated by reference.

TECHNICAL FIELD

The present invention concerns an improved plasma generator for repeatable ignition of propellant charges in a weapon system, e.g. for firing shells from a barrel weapon, through electrical discharge in a combustion chamber enclosure comprising a combustion chamber duct and a combustion chamber substance configured in connection with a propellant charge, as well as a method therefor.

The invention also concerns an ammunition unit comprising a repeatable plasma generator for igniting propellant charges in firing shells from a barrel weapon.

BACKGROUND OF THE INVENTION, ISSUES, AND PRIOR ART

In this case, a conventional barrel weapon refers to a weapon, such as an artillery piece, naval gun, or tank cannon, that comprises a barrel from which a projectile is fired and propelled through the barrel by a propellant charge that is ignited using a pyrotechnic igniter, e.g. an ignition screw, ignition cartridge, etc. The propellant charge, also referred to as the propelling substance, refers here to gunpowder in solid form, and on ignition, it emits gases which, under high pressure inside the barrel, impel the projectile toward the muzzle of the barrel. The propellant charge may also be of a type other than solid gunpowder.

High gas pressure for long periods allows a high muzzle velocity to be achieved. High muzzle velocity of the projectile is used e.g. to increase the range of the weapon, improve the projectile's penetration capacity, or allow the projectile to complete its trajectory in shorter time.

A pressure curve for an optimal combustion process and thus a high firing rate should show an almost immediate pressure increase to $P_{max}$, followed by a stable plateau phase with a constant barrel pressure maintained at $P_{max}$ through the entire time the propellant charge is burning inside the barrel, and should then immediately drop to zero when the projectile leaves the barrel. Ordinarily, all of the propellant charge should have been consumed at this point.

Regardless of which propellant charge is chosen, the ignition process is highly relevant to the course of pressure. A plasma generator having variable ignition energy makes it possible to induce instantaneous flashover ignition of the entire propellant charge and thus allows an immediate pressure increase. A plasma generator also provides the advantage that the ignition energy may be varied over time, which is not the case with a pyrotechnic igniter. Variable ignition energy means that the ignition energy can be adapted to various types and sizes of propellant charges in order to vary the range and also to compensate for the dependency of the propellant charge on temperature.

A parallel development for the purpose of increasing the firing rate of a weapon is to reduce the vulnerability of the propellant substance. Propellant substances of this type are referred to as having "low vulnerability," in English LOVA (LOw VulnerAbility). Low-vulnerability propellant substances are difficult to ignite, which reduces the risk of unintentional ignition of the propellant substance in high-risk situations, e.g. when a combat vehicle comes under enemy fire. This reduced vulnerability also places increased demands on igniters. In such cases, the igniters must generate an increased amount of energy and/or increased pressure in order to bring about the ignition process. Igniters ordinarily contain a readily-ignited ignition substance, and if the amount of this ignition substance is increased, this runs completely counter to the use of a propellant charge of the LOVA type. In principle, ignition takes place by means of an ignition sequence, in which an extremely small amount of vulnerable ignition substance, referred to as the primary explosive, e.g. lead azide or silver azide, is ignited by a mechanical shock or an electrical pulse. The primary explosive then ignites the secondary explosive of the igniter, usually blasting powder. Replacing the pyrotechnic igniter or the entire ignition sequence with a plasma igniter reduces the vulnerability of the system to unintentional ignition. At the same time, this allows increased dynamics so as to generate the more powerful ignition pulse required to ignite low-vulnerability propellant substances (LOVA).

Conventional igniters also entail logistical or technical problems. For barrel weapons that use propellant charges separately from projectiles, such as artillery or larger calibre vehicle-mounted cannons, one often uses a separate ignition cartridge to ignite the propellant charge. One ignition cartridge is used for each firing. A mechanical system must therefore be mounted on the cannon for storage, charging, and removal of the ignition cartridges. By using a plasma igniter, one can avoid the logistical problems connected with the ignition cartridge. A commonly-occurring problem is that the ignition cartridge becomes jammed in the cartridge chamber. The ignition cartridge expands when the weapon system is fired, with the result that the cartridge is firmly wedged in the cartridge chamber, resulting in a misfire. The use of a plasma igniter allows misfiring to be avoided, thus increasing the weapon's functional safety.

Plasma igniters for igniting propellant charges are described e.g. in U.S. Pat. No. 5,231,242 (A) and U.S. Pat. No. 6,703,580 (B2). These plasma igniters are based on the principle of explosive wires, i.e., an electrically conductive wire that is heated, gasified, and partially ionized by an electrical current. The drawback is that the wire is consumed and must be replaced with a new one before each firing. Plasma igniters are therefore of the single-use type.

Repeatable plasma igniters are known in the art, e.g. in patent documents DE-103 35 890 (A1) and DE-40 28 411 (A1). These plasma igniters are based on the principle that an electrically conductive liquid is sprayed in between two electrodes having a potential difference at which the electrical circuit short-circuits and generates an electrical discharge that causes plasma generation. The use of liquids involves a complicated arrangement or easily-ignited substances. The use of liquids also requires complicated logistics for handling said liquids.

PURPOSE AND SPECIAL PROPERTIES OF THE INVENTION

One object of the present invention is an improved method for repeatable ignition of propellant charges in a weapon system in which the complicated dosing and addition of liquids between the electrodes is avoided.

A further object of the present invention is an improved plasma generator for repeatable ignition of propellant charges in a weapon system, in which complicated arrangements for dosing and addition of liquids between electrodes are avoided.

A further object of the present invention is an ammunition unit containing said improved plasma generator.

Said object, as well as other purposes not enumerated here, is satisfactorily achieved within the scope of the information contained in the present patent claims.

Thus the present invention provides an improved method for repeatable ignition of propellant charges in a weapon system, e.g. on firing of a shell from a firing device, through electrical discharge in a combustion chamber duct containing a combustion chamber substance.

The method is characterized in that neutral filling gas in the combustion chamber duct, which may consist of atmospheric gas or residual gas from a previous firing, is ionized by the high-voltage potential applied to the ionizing electrode, which is connected to a first high-voltage generator, thus increasing the electrical conduction capacity, or the conductivity, in the combustion chamber duct. This ionization may be initiated via surface sparkover, volume sparkover, or a transition from surface sparkover, from the bound propellant charges on the surface of the combustion chamber substance, to volume sparkover in the combustion chamber duct. By means of current generated by a second high-voltage generator between a rear electrode and a front electrode in the combustion chamber duct, the filling gas is ionized further, the subsequent effect increases gas pressure in the combustion chamber, and energy is released via recombination among free electrons and ions, as well as neutrals, into photons, which dissociate and ionize the filling gas and the surface of the combustion chamber substance. This surface therefore gives off gas into the combustion chamber duct, which further increases the pressure and adds further neutrals to the volume, which has a braking effect on the impedance collapse that takes place in the combustion chamber duct and increases the amount of electrical effect in the combustion chamber as impedance does not move toward zero, as is the case with gas discharges in open geometry. Pressure and temperature increases in the combustion chamber expel the ignition gas, which has plasma-like and electrically conductive properties, from the passage of one of the terminals to reach the propellant charge to be ignited.

The present invention also provides an improved plasma generator for repeatable ignition of propellant charges in a weapon system, e.g. in firing shells from a barrel weapon, through electrical discharge in a combustion chamber enclosure comprising a combustion chamber duct and a combustion chamber substance configured in connection with a propellant charge.

The improved plasma generator is characterized in that said plasma generator contains an ionizing electrode connected to a first high-voltage generator for the ionization of the filling gas in the combustion chamber duct, and a second high-voltage generator configured for electrical discharge into the electrically conductive gas so that the ignition gas forms under high pressure.

According to further embodiments of the improved plasma generator of the invention, the following is true:

that the electrical discharge from the second high-voltage generator takes place when the conduction capacity in the combustion chamber duct is sufficient to generate electrical sparkover.

that the ionization of the combustion chamber substance is synchronized with the electrical discharge from the second high-voltage generator so that electrical discharge via the second high-voltage generator does not take place until the ionization voltage reaches its voltage maximum or 100 μs before or after the voltage maximum calculated from the voltage maximum.

that the ionizing electrode is solidly configured on the combustion chamber substance, with the ionizing electrode being electrically insulated from the combustion chamber duct and electrically connected to the first high-voltage generator via a passage that is electrically insulated from the combustion chamber enclosure.

that the ionizing electrode is solidly configured on the combustion chamber substance, with the ionizing electrode being in open contact against the combustion chamber duct and electrically connected to the first high-voltage generator via a passage that is electrically insulated from the combustion chamber enclosure.

that the rear electrode configured at the rear end of the combustion chamber duct is electrically connected to the other high-voltage generator, that there is a front electrode configured at the front end of the combustion chamber duct, said back and front electrodes being composed of an electrically conductive material, and that a gas outlet that leads out towards the propellant charge is configured in the forward electrode.

that the gas outlet is conical.

that the combustion chamber substance is tubular and contains a polymer material having a resistivity exceeding 100 ohm-meters.

that the combustion chamber substance is divided into several layers.

that the combustion chamber substance contains a mixture of polymer and metallic material.

The present invention further provides an improved ammunition unit containing a shell casing, a projectile, a propellant charge, and an ignition device, with said ignition device comprising a plasma generator.

BENEFITS AND EFFECTS OF THE INVENTION

Weapons systems can be ignited more simply and safely using the proposed repeatable plasma generator. Because vulnerable ignition substances and ignition cartridges are avoided, complete use of low-vulnerability propellant charges can be achieved. Problems with vulnerable mechanical devices as a mechanism for changing the ignition cartridge or dosing equipment for liquids can be dispensed with. The technology involves increased control of ignition pulses with respect to parameters such as energy content, pulse length, and initial ignition time. The ignition pulse can be adaptively adjusted to the size of the propellant charge, depending on the amount of propellant substance, the vulnerability of the propellant charge, and the ambient temperature.

EXPLANATION OF FIGURES

The invention will be explained in the following in greater detail with reference to the attached Figures, in which.

DETAILED DESCRIPTION OF THE EMBODIMENTS

Figure 1:
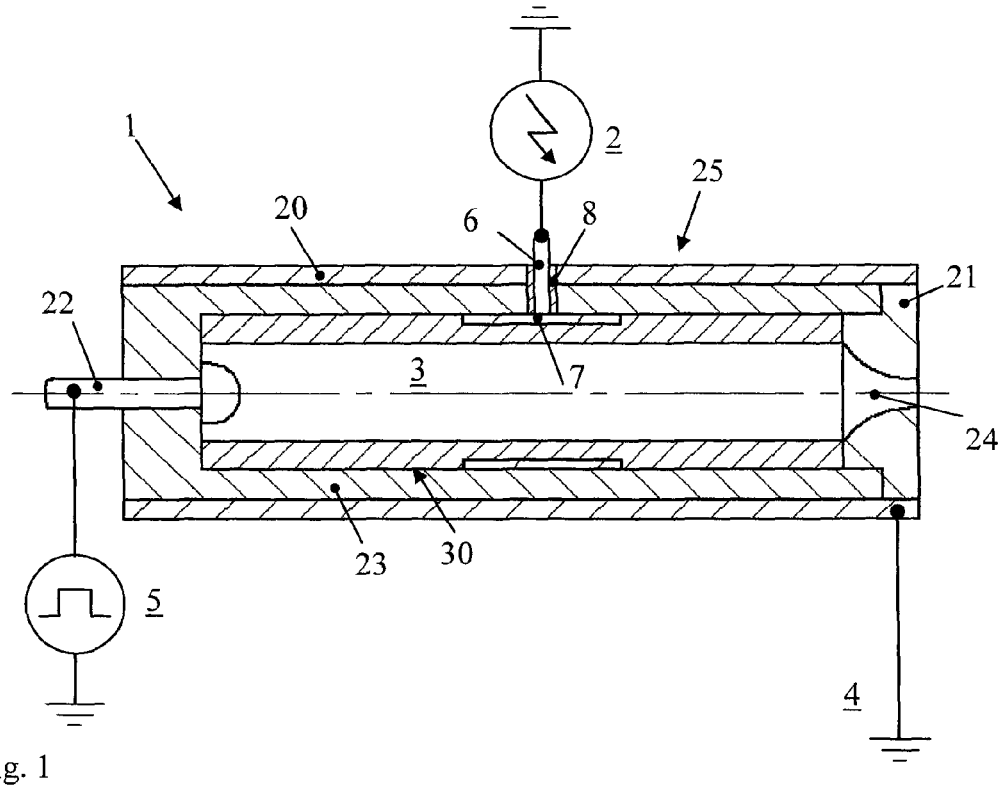
FIG. 1 shows a schematic longitudinal view of a repeatable plasma generator according to the invention.

The plasma generator 1 shown in FIG. 1 comprises an outer casing in the form of a tubular and electrically conductive combustion chamber enclosure 20, preferably consisting of a metallic material. The combustion chamber enclosure 20 is connected to a front electrode 21. Within the combustion chamber enclosure 20 is configured both a combustion chamber substance 30 and an electrical insulator 23. The electrical insulator 23, which is preferably cylindrical, is mounted within the combustion chamber enclosure 20 and functions as an electrical insulator between the combustion chamber enclosure 20 and the combustion chamber substance 30. The electrical insulator 23 is an electrical and thermal insulator in the form e.g. of a dielectric, pressure- and heat-resistant polymer lining, ceramic lining, ceramic layer, or other ceramic unit, molded with a tubular part enclosing the combustion chamber substance 30 and a molded part for mounting of a rear electrode 22 in the centre of the combustion chamber duct 3.

The combustion chamber substance 30, preferably tubular, is mounted within the electrical insulator 23 and forms the combustion chamber duct 3 of the plasma generator. The combustion chamber duct 3 extends axially through the plasma combustor between a front electrode 21 and the rear electrode 22. The front part of the combustion chamber duct 3, i.e., the gas outlet 24 of the plasma generator 1, is preferably formed as a nozzle mounted or directly machined in the front electrode 21. The front electrode 21 is connected to the electrical ground 4 and is in electrical contact with the combustion chamber enclosure 20. The rear electrode 22 is electrically connected to a high-voltage generator 5, also referred to as the second high-voltage generator, and mounted in the electrical insulator 23. An ionizing electrode 7, fully or partially enclosing the combustion chamber duct 3, is connected to an external high-voltage generator 2, also referred to as the first high-voltage generator, via a passage 6 which is electrically insulated 8 from the combustion chamber enclosure 20. The combustion chamber 25 of the plasma generator 1 therefore contains the combustion chamber enclosure 20, the electrical insulator 23, the front electrode 21, the rear electrode 22, the ionizing electrode 7, the electrical passage 6 to the ionizing electrode, the electrical insulator 8 for the passage 6, and the combustion chamber substance 30.

The combustion chamber substance 30 contains a sacrificial material configured between the front electrode 21 and the electrical insulator 23, preferably in the form of a tube.

The electrical insulator 23 and combustion chamber enclosure 20 are mounted by being screwed together. After this, the combustion chamber substance 30 and the insulator 23 are mounted, after which the front electrode 21 and rear electrode 22 are screwed into place on the combustion chamber enclosure 20 and on the electrical insulator 23 with a specified amount of force. By means of these measures, the combustion chamber substance 30 is fixed in place in a predetermined manner, with the vulnerability of the plasma generator 1 to shocks or vibrations largely being eliminated.

Figure 2:
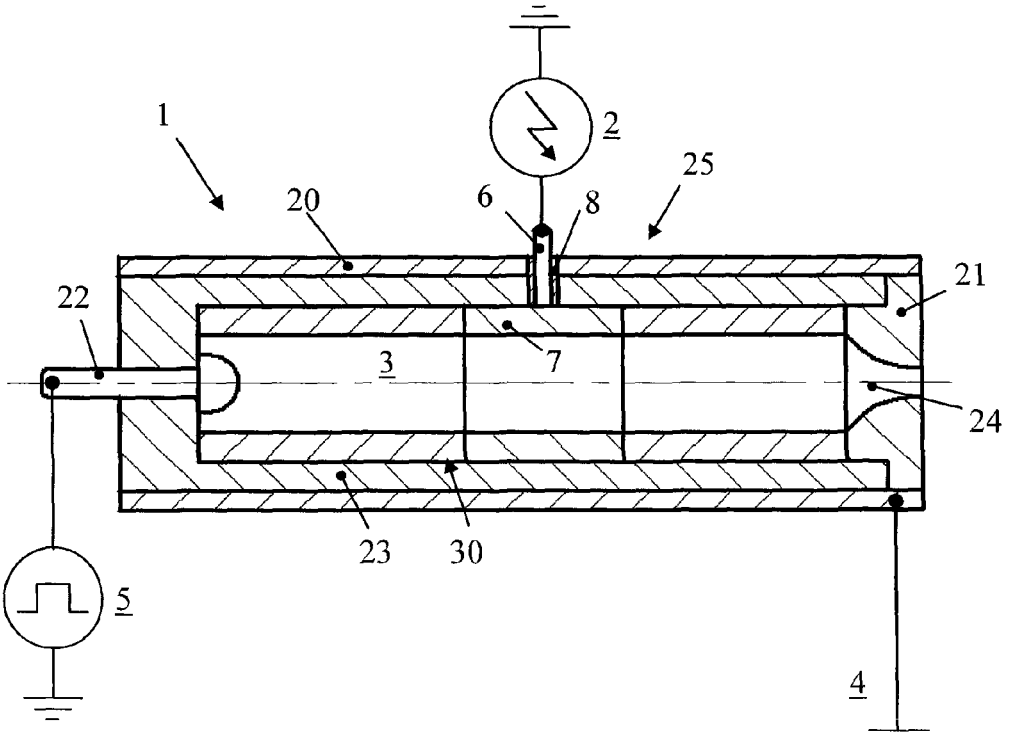
FIG. 2 shows a schematic view of an alternate embodiment of FIG. 1.

FIG. 2 shows an alternate embodiment of the plasma generator in which the main difference from the embodiment in FIG. 1 is the exposure of the ionizing electrode 7 to the combustion chamber duct 3, without any electrical insulation of the combustion chamber substance 30 occurring between the ionizing electrode 7 and the combustion chamber duct 3.

Figure 3:
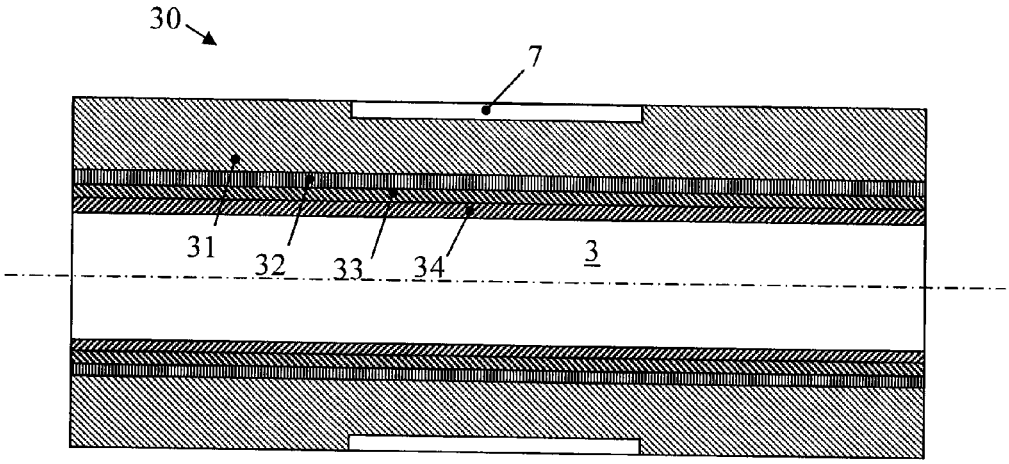
FIG. 3 shows a detail enlargement of the combustion chamber substance in FIG. 1.

The combustion chamber substance 30 according to FIG. 3 is preferably configured so as to be used in a layered fashion by successive combustion of the three substance layers 32, 33, and 34 shown in FIG. 3. Additional substance layers may of course be added. For each ignition, one layer is consumed, and with each new energy pulse toward the exposed surface of the body 31 in the combustion chamber duct 3, the surface is completely or partially gasified and generates a plasma created by the electrical discharges between the rear electrode 22 and the front electrode 21.

The first pulse gasifies substance layer 34, with substance layer 33 being exposed to the combustion chamber duct 3. After this, the next pulse gasifies the next layer, 33, and so forth. Gasification may take place layer by layer in either the axial or radial limb, but can also take place via increased consumption of material in front of the ionizing electrode 7, declining toward the front electrode 21 and the rear electrode 22. Other consumption methods are also possible. The completely or partially consumed combustion chamber substance 30 can simply be replaced by a new substance as needed.

The combustion chamber substance 30 may be configured e.g. by lamination technology in which a certain number of layers or strata are joined together in accordance with the number of ignition pulses the plasma generator 1 has been designed to generate. The combustion chamber substance 30 can also be made of a homogenous material or of a homogenous material in combination with lamination, or by sintering, pressing, or another joining technique suitable for combining metallic and polymer material, with an order of magnitude ratio of 10-50% (w/w) of a polymer material and 50-90% (w/w) of a polymer material. Varying the amount of energy supplied to the plasma generator can also be used to gasify one or more layers of a laminated combustion chamber substance 30 or a varied mass of the combustion chamber substance 30 composed of a homogeneous material.

The filling gas in the combustion chamber duct 3 is ionized with the ionizing electrode 7, which increases conduction capacity and makes it possible to generate an extremely powerful electrical energy pulse of specified duration, amplitude and shape between the front electrode 21 and the rear electrode 22, which causes the outer layer to heat up, gasify, or be ionized either completely or partially, by strata or layer by layer, into the plasma, hot gas, or hot particles, with a predetermined plasma being caused to flow out through the terminal mouth opening 24 at extremely high pressure and extremely high temperature, and containing a large amount of gas and hot particles.

The combustion chamber substance 30 contains at least one sacrificial material that breaks down in the formed plasma into molecules, atoms, or ions at the least. Such a sacrificial material may suitably contain e.g. hydrogen and carbon. For the generation of hot particles, a metallic material in combination with e.g. hydrogen and carbon may form a part of the combustion chamber substance 30. The combustion chamber substance 30 in the described embodiments includes at least one dielectric polymer material, preferably a plastic with a high melting point (preferably above 150° C.), a high gasification temperature (above 550° C., and preferably above 800° C.), and a low heat conduction capacity (preferably below 0.3 W/mK). Particularly suitable plastics include thermoplastics or hard plastics, such as polyethylene, and fluoroplastics (such as polytetrafluorethylene), so that only one outer layer or layers 32, 33, or 34 of the combustion chamber substance 30 gasifies for each energy pulse.

The sacrificial material in the combustion chamber substance 30 should preferably also be sublimating, i.e., go directly from a solid form to a gas form. It is also conceivable that one could configure various materials, of varying thickness, etc. as a laminated combustion chamber substance 30 in order to carry out said layered 32, 33, 34 gasification of the laminate in the combustion chamber substance 30. Or one could also use sintering, pressing, or another joining technique to combine the metallic and/or polymer material into a combustion chamber substance 30 in order to carry out said layered 32, 33, 34 gasification of the laminate in the combustion chamber substance 30.

The inner and outer radii of the combustion chamber substance 30 are calculated, dimensioned, and machined in such a manner that only the outermost surface, which is the surface of the combustion chamber substance 30 exposed from the combustion chamber duct 3 that turns freely between the front electrode 22 and the rear electrode 21, i.e. the outer surface or layers 32, 33, and 34, is gasified with each electrical pulse. Ideally, the combustion chamber substance 30 should be used last for the plasma generation planned for the plasma generator 1.

When consumption of the combustion chamber substance can be considered to be capable of dynamic alteration between each use, depending on the design of e.g. the propellant substance, the projectile, the ambient temperature, or the nature of the target, the combustion chamber substance 30 is machined with a specified margin so that it can function within the designs that are conceivable based on the application.

Figure 4:
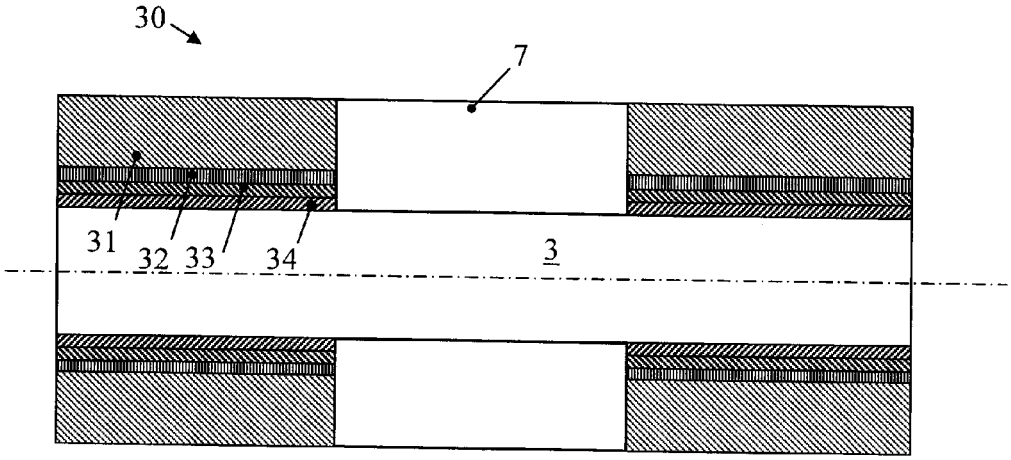
FIG. 4 shows a detail enlargement of the combustion chamber substance in FIG. 2.

An alternate embodiment of the combustion chamber substance is shown in FIG. 4, where the ionizing electrode 7 is in open contact with the combustion chamber duct 3. In this case, ionization of the surface will take place in both the axial and radial limb starting from the centre electrode. In order to prevent the electrical energy pulse between the rear electrode 22 and the front electrode 21 from going through the ionizing electrode 7, the circuit is equipped with a safety circuit, not shown in the Figure, either between or within the high-voltage generator 2 and the ionizing electrode 7.

Figure 5:
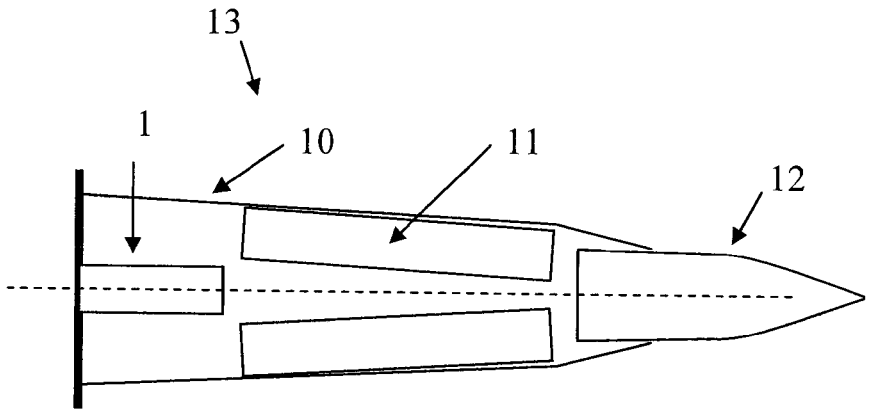
FIG. 5 shows a schematic perspective view of an ammunition unit containing a plasma generator according to the invention.

FIG. 5 shows an ammunition unit 13 equipped with a housing and having an integrated plasma generator. The plasma generator 1 is mounted in a cartridge housing 10 together with a propellant charge 11 and a projectile 12. For example, the propellant charge 11 may be a solid powder containing at least one charging unit in the form of one or more cylindrical bars, plates, blocks, etc.

The charging units are multiperforated with a large number of combustion ducts so that a so-called multiperforated powder is obtained. Alternative embodiments of the propellant charge 11 are of course possible.

Description of Function

The function and application of the plasma generator 1 according to the invention are as follows.

On firing, the first high-voltage generator 2 connected to the ionizing electrode 7 is caused to emit a high-voltage pulse in order to ionize the filling gas in the combustion chamber duct 3, and when the degree of ionization is such that plasma generation can be initiated, the other high-voltage generator 5 is caused to emit a powerful electrical pulse having a high amperage and/or a high voltage, both with a certain specified amplitude and pulse length adapted for the conditions pertaining to the relevant weapon, the temperature, the propellant charge, the projectile, the environment of the target, etc. The impedance of the plasma generator 1 is in an active state, i.e. it is low during plasma generation, which is why a high level of power should be generated from the other high-voltage generator 5, on the order of magnitude of 10-100 kA, and in order to achieve successful flashover ignition, a high voltage is required on the order of magnitude of 4-10 kV. In order to obtain effective plasma, before flashover ignition of the propellant bed, each energy pulse should exceed 1 kJ, but can be as high as 30 kJ, and the plasma should be added with a pulse length of between 1 μs and 10 ms.

The powerful electrical energy pulse will generate electrical flashover ignition, also referred to below as an arc discharge, between the rear electrode 22 and the front electrode 21, and in the plasma channel made by the arc discharge, the temperature becomes so high that the outermost layer/stratum of the combustion chamber 30 melts, gasifies, and is finally ionized to an extremely hot plasma. In an alternate embodiment, a substance added to the combustion chamber duct 3 can be one portion of the substance that forms the plasma in connection with the arc discharge. The generated plasma-like gas is caused, because of the high pressure generated by gasification in the combustion chamber duct 3, to spray out through the gas outlet 24, with said gas outlet 24 being in the form of a nozzle. Pulse length, pulse form, amperage, and voltage may vary depending on the relevant conditions of firing, such as the ambient temperature, humidity, etc., and for the present weapon system, special properties of the ammunition or projectile type, as well as the relevant type of target, including the distance from said target.

Example of Preferred Embodiment

In an example of a plasma generator according to the invention, designed for use in an artillery system as a replacement for conventional ignition cartridges, the combustion chamber enclosure 20 is on an order of magnitude of 30-60 mm, it contains an electrical insulator 23, and within the electrical insulator 23, a combustion chamber substance 30 of various polymer materials and thicknesses. In this case, said combustion chamber substance 30 was specially dimensioned for thicknesses of approx. 1-10 mm, allowing layered gasification of the combustion chamber substance to be achieved with an energy pulse of approx. 1-10 kJ, length of several ms, and voltage in the range of 5-10 kV. Amperage is in the range of 1-50 kA. The distance between the front electrode 21 and the rear electrode 22 was on the order of magnitude of 20-100 mm.

Alternate Embodiments

The invention is not limited to the specially described embodiments above, but may vary in different ways within the scope of the patent claim.

It is understood, for example, that the number, size, material, and form of the elements and details comprising the ammunition unit and the plasma generator are to be adjusted depending on the weapon system or systems and other structural properties that may apply.

It is understood that the ammunition embodiment described above may include many different dimensions and projectile types depending on the scope of use and the width of the barrel. In this case, however, it is understood that said embodiment comprises at least the most common current shell types, measuring approx. 25 mm-160 mm.

In the embodiments described above, the plasma generator contains only one front gas outlet, but it falls within the scope of the invention to configure several such openings along the surface of the combustion chamber duct or several openings in the front opening 24.

The plasma generator is repeatable, but can also be used in a single-use embodiment, e.g. in an ammunition application, as an igniter for a combat component, or for ignition of rocket engines.

The invention claimed is:

1. Plasma generator for repeatable ignition of propellant charges in a weapon system through electrical discharge in a combustion chamber enclosure containing a combustion chamber duct and a combustion chamber substance configured in connection with a combustion charge, wherein the plasma generator contains an ionization electrode connected to a first high-voltage generator for ionization of a filling gas in the combustion chamber duct for producing an electrically conductive gas and a front electrode connected to an electrical ground and a rear electrode electrically connected to a second high-voltage generator configured for electrical discharge in the electrically conductive gas so that hot ignition gas is formed under high pressure.

2. Plasma generator according to claim 1, wherein the electrical discharge from the second high-voltage generator takes place when the conduction capacity in the combustion chamber duct is sufficient to generate electrical sparkover.

3. Plasma generator according to claim 2, wherein ionization of the combustion chamber substance is synchronized with the electrical discharge from the second high-temperature generator so that the electrical discharge via the second high-voltage generator does not take place until the ionization voltage reaches its voltage maximum or 100 μβ before or after the voltage maximum calculated from the voltage maximum.

4. Plasma generator according to claim 2, wherein the ionizing electrode is solidly configured on the combustion chamber substance-, with the ionizing electrode being electrically insulated from the combustion chamber duct and electrically connected to the first high-voltage generator via a passage that is electrically insulated from the combustion chamber enclosure.

5. Plasma generator according to claim 2, wherein the ionizing electrode is solidly configured on the combustion chamber substance, with the ionizing electrode being in open contact against the combustion chamber duct and electrically connected to the first high-voltage generator via a passage that is electrically insulated from the combustion chamber enclosure.

6. Plasma generator according to claim 2, wherein the rear electrode configured at the rear end of the combustion chamber duct is electrically connected to the other high-voltage generator, in that there is a front electrode configured at the front end of the combustion chamber duct, said back and front electrodes being composed of an electrically conductive material, and in that that a gas outlet that leads out towards the propellant charge is configured in the front electrode.

7. Plasma generator according to claim 1, wherein ionization of the combustion chamber substance is synchronized with the electrical discharge from the second high-temperature generator so that the electrical discharge via the second high-voltage generator does not take place until the ionization voltage reaches its voltage maximum or 100 μβ before or after the voltage maximum calculated from the voltage maximum.

8. Plasma generator according to claim 7, wherein the ionizing electrode is solidly configured on the combustion chamber substance, with the ionizing electrode being electrically insulated from the combustion chamber duct and electrically connected to the first high-voltage generator via a passage that is electrically insulated from the combustion chamber enclosure.

9. Plasma generator according to claim 7, wherein the ionizing electrode is solidly configured on the combustion chamber substance, with the ionizing electrode being in open contact against the combustion chamber duct and electrically connected to the first high-voltage generator via a passage that is electrically insulated from the combustion chamber enclosure.

10. Plasma generator according to claim 1, wherein the ionizing electrode is solidly configured on the combustion chamber substance, with the ionizing electrode being electrically insulated from the combustion chamber duct and electrically connected to the first high-voltage generator via a passage that is electrically insulated from the combustion chamber enclosure.

11. Plasma generator according to claim 10, wherein the ionizing electrode is solidly configured on the combustion chamber substance, with the ionizing electrode being in open contact against the combustion chamber duct and electrically connected to the first high-voltage generator via a passage that is electrically insulated from the combustion chamber enclosure.

12. Plasma generator according to claim 1, wherein the ionizing electrode is solidly configured on the combustion chamber substance, with the ionizing electrode being in open contact against the combustion chamber duct and electrically connected to the first high-voltage generator via a passage that is electrically insulated from the combustion chamber enclosure.

13. Plasma generator according to claim 1, wherein the rear electrode configured at the rear end of the combustion chamber duct is electrically connected to the other high-voltage generator, in that there is a front electrode configured at the front end of the combustion chamber duct, said back and front electrodes being composed of an electrically conductive material, and in that that a gas outlet that leads out towards the propellant charge is configured in the front electrode.

14. Plasma generator according to claim 13 wherein the gas outlet is conical.

15. Plasma generator according to claim 1, wherein the combustion chamber substance is tubular and contains a polymer material having a resistivity exceeding 100 ohm-meters.

16. Plasma generator according to claim 1, wherein the combustion chamber substance is divided into several layers.

17. Plasma generator according to claim 1, wherein the combustion chamber substance contains a mixture of polymer and metallic material.

18. Plasma generator according to claim 1, wherein the rear electrode configured at the rear end of the combustion chamber duct is electrically connected to the other high-voltage generator, in that there is a front electrode configured at the front end of the combustion chamber duct, said back and front electrodes being composed of an electrically conductive material, and in that that a gas outlet that leads out towards the propellant charge is configured in the front electrode.

19. Ammunition unit containing a shell casing, a projectile, a propellant charge, and an ignition device wherein said ignition device comprises a plasma generator according to claim 1.

* * * * *